United States Patent [19]

Kellis

[11] Patent Number: 5,016,415

[45] Date of Patent: May 21, 1991

[54] INSULATED PANEL SIDING

[76] Inventor: Warren D. Kellis, 2970 Quail Run, Troy, Mich. 48098

[21] Appl. No.: 439,846

[22] Filed: Nov. 21, 1989

[51] Int. Cl.[5] ..... E04D 1/00; E04B 2/08

[52] U.S. Cl. ..... 52/522; 52/531; 52/545

[58] Field of Search ..... 52/521, 533, 539, 546, 52/404, 521, 522, 529, 545

[56] References Cited

U.S. PATENT DOCUMENTS

| | | | |
|---|---|---|---|
| 2,264,546 | 12/1941 | Ochs | 52/521 |
| 2,961,804 | 11/1960 | Beckman | 52/539 |
| 3,458,962 | 8/1969 | Kendall | 52/531 X |
| 3,603,057 | 9/1971 | Curran | 52/539 X |
| 3,780,483 | 12/1973 | Mattes | 52/531 X |
| 4,154,040 | 5/1979 | Pace | 52/531 X |
| 4,327,528 | 5/1982 | Fritz | 52/533 X |
| 4,506,486 | 3/1985 | Culpepper, Jr. et al. | 52/529 |
| 4,788,808 | 12/1988 | Slocum | 52/521 |

*Primary Examiner*—David A. Scherbel
*Assistant Examiner*—Michele A. Van Patten
*Attorney, Agent, or Firm*—Barnes,Kisselle,Raisch,Choate,Whittemore & Hulbert

[57] ABSTRACT

Panel siding for the wall of a building comprising elongated panels arranged in close, parallel relationship with the longitudinal edges of adjacent panels opposed to one another. The panels have integral tongue and groove formations along the opposed longitudinal edges which are interengaged to provide connections between panels. A layer of insulation is provided at the rear of each panel, providing a panel insulation unit. Each panel insulation unit is installed in a single step.

17 Claims, 3 Drawing Sheets

INSULATED PANEL SIDING

This invention relates generally to siding for a wall of a building or the like and more particularly to exterior wall panel siding.

BACKGROUND AND SUMMARY

In the past and at present, the use of backer insulation material on panel siding, particularly vinyl siding, has not been available. Also, there has been no way to fasten a backer of insulation to a panel other than by the use of adhesives. Use of adhesives (gluing) has proven unsuccessful because of the tendency of the panel to expand and contract. Adhesives will not permit free expansion and contraction and will cause the panel to buckle. The panels of the present invention are designed to provide built-in receivers on the back to accommodate insulation. No adhesive is required and hence the panels are free to expand and contract. Moreover, the panel-insulation units may be installed in a single step, reducing labor costs.

The panel siding of this invention has specially designed panels with a unique tongue and groove interlock between panels. The tongue and groove interlock is engaged simply and easily during installation. The tongue and groove interlock provides a seal without restricting expansion or contraction of the panels.

The panel siding of this invention may be installed from the bottom up or from the top down. In addition to vertical application on a wall, the paneling may be used as horizontal siding or for soffits. Preferably, the panels are prenotched at the ends to allow for overlapping of the panels, have built in weep holes for moisture control, and have a projected in place "R" factor of between 3 and 5, whereas panels in other known systems have only a 0.80 "R" factor or something less than 1.

The object of this invention is to provide panel siding having some or all of the above features. Other objects will become more apparent as the following description proceeds, especially when considered with the accompanying drawings.

DETAILED DESCRIPTION

Figure 2:
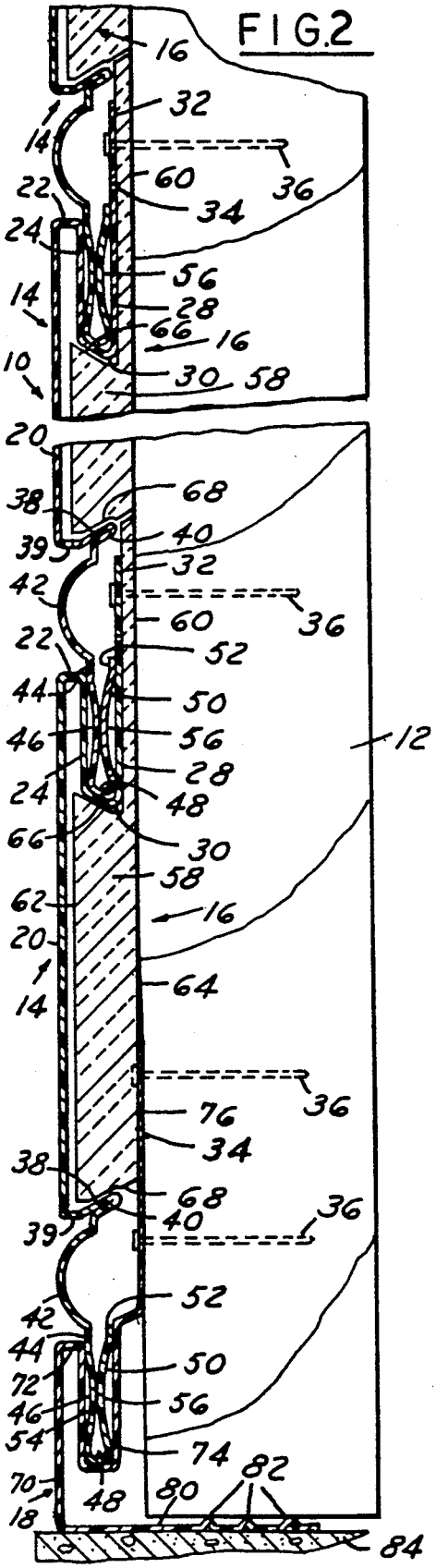
FIG. 2 is a fragmentary sectional view taken on the line 2—2 in FIG. 1
Figure 1:
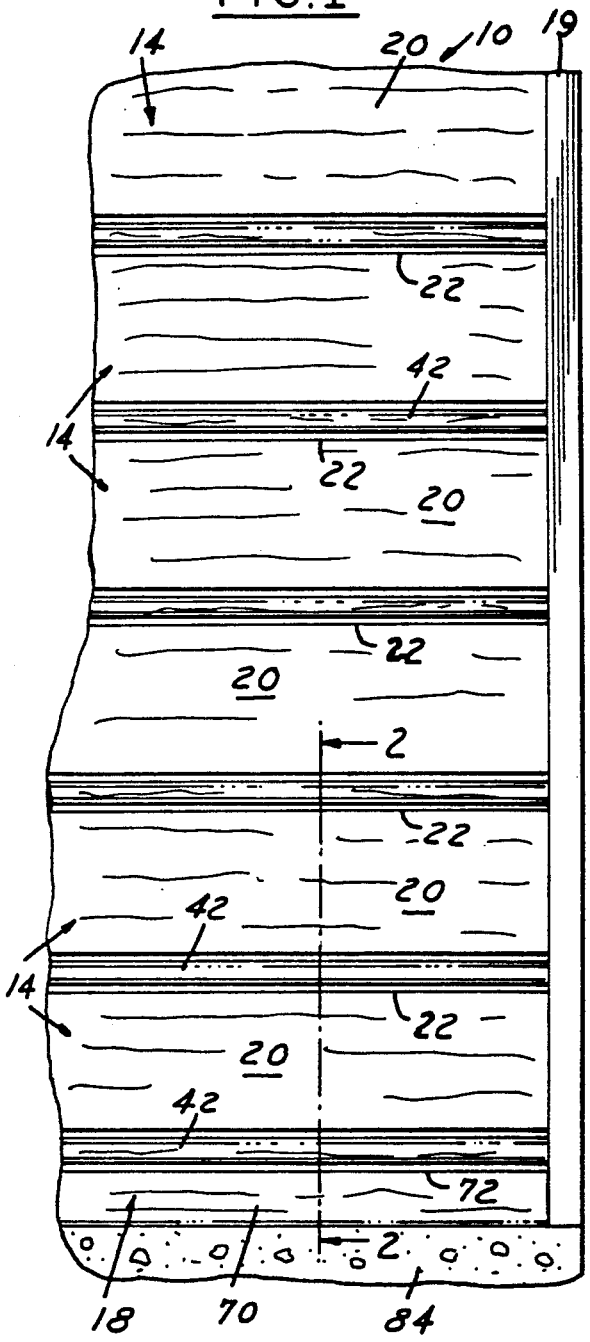
FIG. 1 is a fragmentary elevational view showing the panel siding of this invention applied to the wall of a building, in which the panels are installed from the bottom up.
Figure 3:
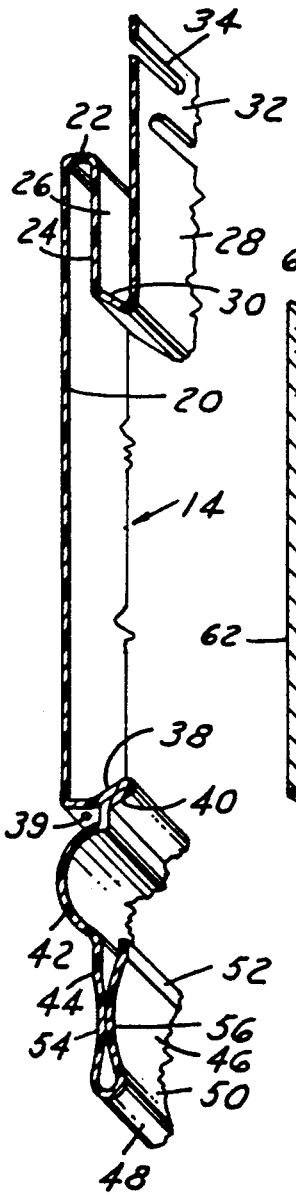
FIG. 3 is a fragmentary transverse sectional view in perspective of one of the specially formed panels.
Figure 4:
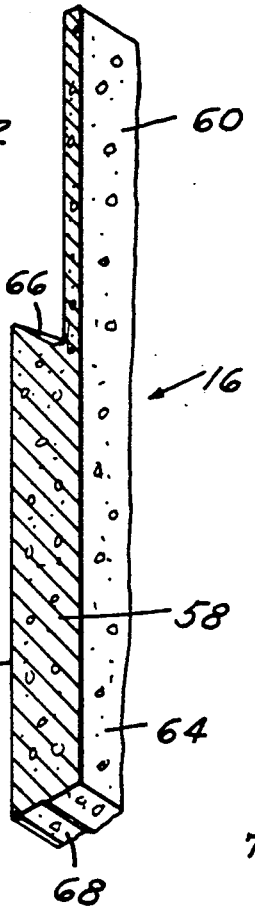
FIG. 4 is a fragmentary perspective view showing the configuration of the layer of insulation associated with each panel.
Figure 5:
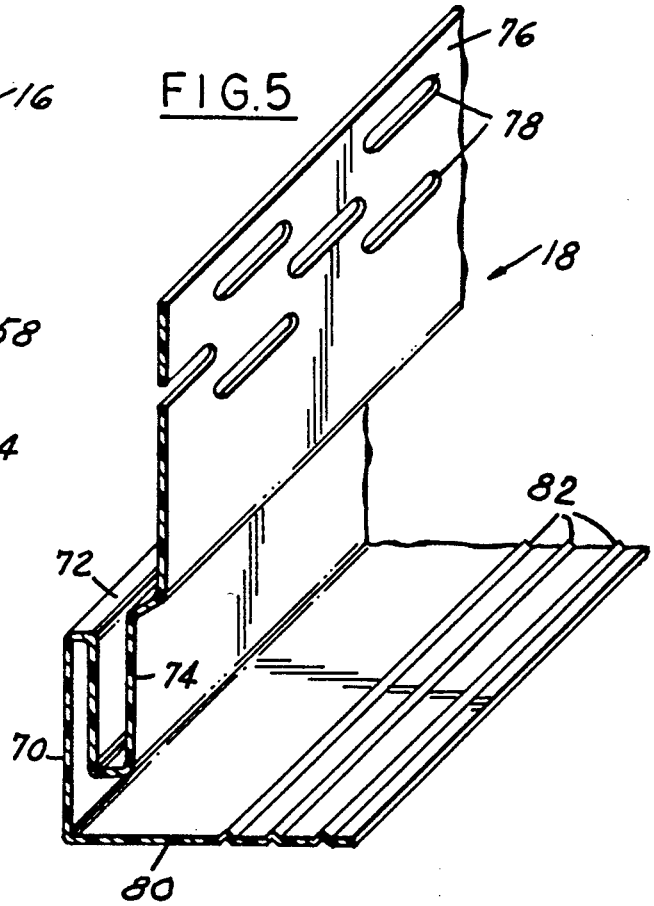
FIG. 5 is a sectional view in perspective showing the panel-like starter strip which provides a finished edge along the bottom of the assembled panel siding.

Referring now more particularly to the drawings and especially to FIGS. 1–5, the numeral 10 designates the siding of this invention shown applied to the vertical wall 12 of a building. The siding 10 comprises panels 14 and layers 16 of insulation, together with a panel-like starter strip 18 at the bottom of the siding and finish strips 19 at the side edge of the siding shown in FIG. 1 and also at the opposite side edge and at the top, not shown.

The siding is made up primarily of panel-insulation units each having a panel 14 backed by a backer or layer 16 of insulation. These panel-insulation units may extend for the full width of the building wall 12. Often, however, the panel-insulation units are shorter than the width of the building wall, with the panels notched at the ends to provide an overlap at the joints.

The panels 14 are of identical construction. Each panel 14 is an elongated relatively thin strip of any suitable relative stiff, somewhat flexible material. The panels may be formed of vinyl, for example, and may be of any suitable or convenient length, preferably having a thickness on the order of about 0.040 of an inch. The panels throughout their length are of the cross-sectional configuration clearly shown in FIGS. 2 and 3.

Each panel has a flat vertical front face 20. At the top of the front face 20, the panel has a rearwardly turned generally horizontal portion indicated at 22, leading to a vertical front wall 24 of a vertically upwardly opening channel 26. The channel 26 also has a vertical rear wall 28 which is spaced from and parallel to the front wall 24. The bottoms of these channel walls 24 and 26 are connected by a bottom wall 30. The bottom wall slopes downwardly and rearwardly preferably at an angle of about 30° to the horizontal, and serves as an upper retainer for the insulation, as described more fully hereinafter.

The rear wall 28 of the channel has an upward extension providing an attaching strip 32. The attaching strip 32 is formed with horizontally elongated nailing slots 34 to receive nails 36 for securing the panels to the building wall 12. The slots 34 are arranged in two or more vertically spaced rows, with the slots in each row spaced from one another and staggered with respect to the slots in the adjacent row. The channel 26 provides the groove of a tongue and groove connection between panels, as more fully described hereinafter.

At the lower edge of the front face 20, the panel has a rearwardly turned portion 38 which is inclined upwardly, preferably at an angle of about 30° to the horizontal and serves as a lower retainer for the insulation, as described more fully hereinafter. Weep holes 39 are formed in the portion 38 at longitudinally spaced points, for escape of moisture. This rearwardly turned portion 38 is folded or bent upon itself where indicated at 40 and then leads downwardly to a forwardly convex arcuate bead 42. Extending downwardly from the bead 42 is the front wall 44 of a vertical generally U-shaped projection 46 providing the tongue of the tongue and groove connection between panels.

The U-shaped projection or tongue 46 has an arcuate portion 48 at the bottom and a rear wall 50 extending upwardly from the arcuate portion 48 alongside front wall 44 to its upper terminal edge 52. The front and rear walls 44 and 50 are spaced apart at the top and bottom, but have intermediate arcuate portions 54 and 56 which contact one another. The distance between the front wall 44 at the top thereof and the terminal edge 52 in the free, unflexed condition of tongue 46 is slightly greater than the width of groove 26 measured between the front and rear walls 24 and 28 thereof. Thus, when a tongue of one panel enters a groove of an adjacent panel, it will engage therein with a friction fit and the edge 52 of the tongue will seal against the rear wall 28 of the groove.

The layers 16 of insulation are of identical shape and may be of any suitable , preferably relatively stiff or self-supporting, preformed material having a degree of flexibility, such, for example, as "Styrofoam." The layer 16 of insulation has an elongated main body portion 58 and an integral extension 60 along the full length of the main body portion. The layers of insulation are of the same length as panels 14, and throughout their length have the cross-section shown in FIGS. 2 and 4.

The main body portion 58 is trapezoidal, having the parallel vertical front and rear surfaces 62 and 64 and the top and bottom surfaces 66 and 68 which are tapered so as to converge in a rearward direction at equal angles of about 30°. The extension 60 is of reduced thickness relative to the main body portion 58 and extends vertically upwardly from the rear part of the top surface 66 with its rear surface a continuation of the rear surface 64 of the main body portion.

As already stated, the bottom wall 30 of channel 26 and panel portion 38 serve as insulation retainers. Because these retainers 30 and 38 are open at the panel ends, each layer 16 of insulation is assembled with a panel 14 to form a panel-insulation unit by a relative endwise movement sliding the two to the position shown in FIG. 2. In that position, the main body portion 58 is disposed at the rear of the front face 20 of the panel with the top and bottom surfaces 66 and 68 retained between the bottom wall 30 of channel 26 of the panel and the rearwardly turned portion 38 of the panel. The extension 60 extends along the rear side of the rear wall 28 of the channel and the attaching strip 32.

The starter strip 18 may be of the same material, length and thickness as panels 14. It is an elongated member, having throughout its length the cross-section shown in FIGS. 2 and 5. Starter strip 18 has a vertical front face 70, a rearwardly turned generally horizontal portion 72 and a vertically upwardly opening channel 74, like the corresponding parts of the panels 14. The starter 18 also has an attaching strip 76 like the attaching strip 32 of the panels, but offset rearwardly from the channel 74. The attaching strip 76 has two or more vertically spaced rows of spaced and staggered, horizontally elongated nailing slots 78, like those in the attaching strip 32 of panels 14. The starter 18 has at the bottom of its front face 70 a rearwardly extending, generally horizontal support leg 80 formed with elongated, V-shaped ridges 82 providing cut-off points for shortening the leg if desired. The leg 80 provides a support adapted to rest on the horizontal foundation 84 adjacent wall 12.

In use, the starter 18 is first secured to the bottom of the wall 12 in horizontal position with its leg 80 horizontal and resting upon the foundation 84 and its attaching strip 76 vertical and flush against wall 12. Leg 80 may extend under wall 12 as shown. The starter 18 is secured to wall 12 by nails 36 through slots 78.

The panel-insulation units are then applied. Each unit is applied in a single step, starting with the bottom-most one, the tongue 46 of which is pressed down into the channel 74 of the starter in a direction transverse to their length. This panel-insulation unit, which is horizontal, is then secured to the wall 12 by nails 36 through slots 34 and through the insulation extension 60. The next panel-insulation unit is installed by pressing its tongue 46 down into the channel 26 of the first-installed panel-insulation unit and nailing in like manner. Succeeding panel-insulation units are installed one by one from the bottom up in the same manner. The installed panel-insulation units lie in a common vertical plane. When all panel-insulation units have been installed, the finish strips 19 are applied.

In the assembled or installed condition, the tongue 46 of each panel 14 fits frictionally into the groove or channel of the panel (or starter) below, with the terminal edge 52 tightly engaging the wall of the channel to form a moisture seal. The entire back of each panel is insulated, with the main body portion 58 of the insulation layer insulating most of the front face of the panel and the extension 60 insulating from the main body portion up to the top of the attaching strip 32 to insulate the tongue and groove connection. The upper edge of the extension 60 of the insulation of a lower panel-insulation unit substantially abuts the main body portion 58 of the insulation of the next higher unit.

The elongated nailing slots 34 permit the panels 14 to move longitudinally over the insulation layers 16 due to expansion and contraction. The elongated nailing slots 78 in starter 18 also allow for expansion and contraction.

Figure 6:
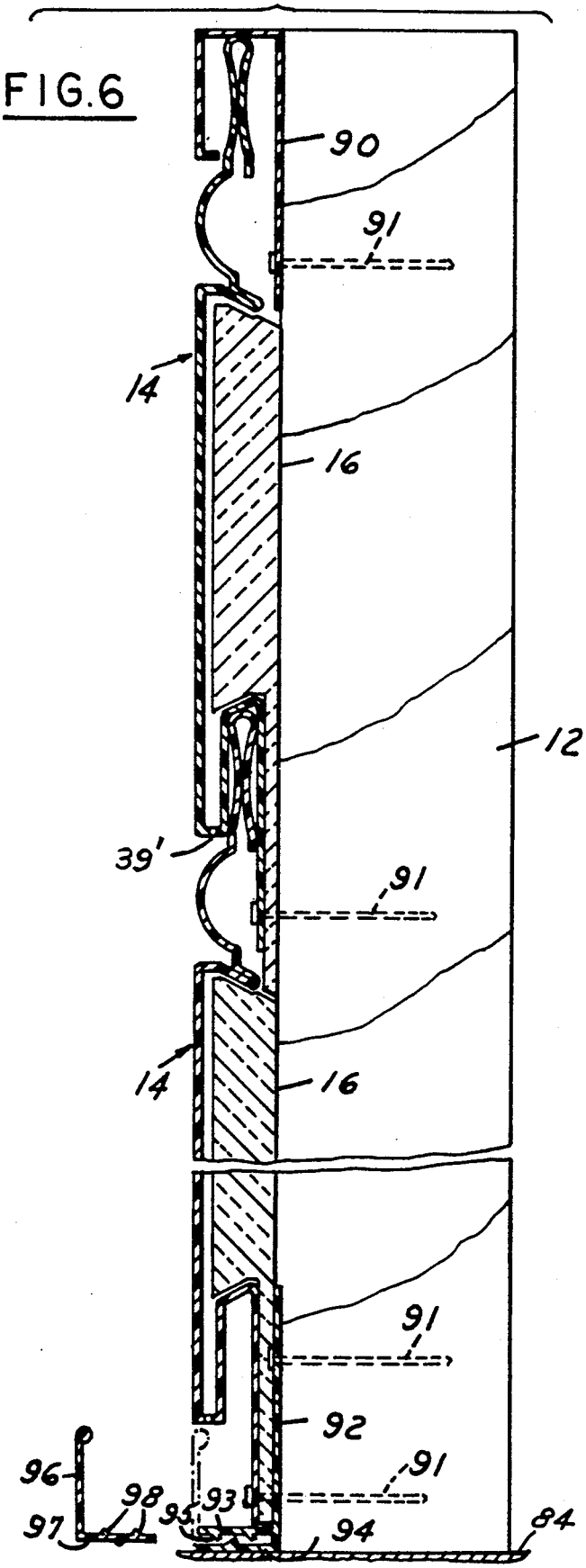
FIG. 6 is similar to FIG. 2 but in which the panels are installed from the top down.

FIG. 6 shows the panel siding after having been installed from the top down. The starter 90 is a J-shaped channel which is first secured in inverted position to the top of the wall 12 in horizontal position with the long leg pressed flush against the wall 12 to which it is secured by nails 91. The starter channel 90 may have horizontally elongated nailing slots (not shown) like the nailing slots 78 in starter strip 18, for receiving the nails 91 and allowing for expansion and contraction.

The panel-insulation units are then applied. These units, made up of the panels 14 and insulation 16, may be identical to those shown in FIG. 1–5, or they may differ by having the longitudinally spaced weep holes, designated 39', formed in the rearwardly turned, generally horizontal portion 22, rather than in the portion 38. Each panel-insulation unit is applied in a single step, starting with the upper-most one, the tongue 46 of which is extended up into the channel of the starter strip 90. This panel-insulation unit, which is horizontal, is then secured to the wall 12 by the nails 91 through slots 34 and through the insulation extension 60. The next panel-insulation unit is installed by pressing its tongue 46 up into the channel 26 of the first-installed panel-insulation unit and nailing in like manner. The installation procedure is the same as in FIG. 1–5, except that the panel-insulation units are inverted and installed from the top down. Succeeding panel-insulation units are installed one by one from the top down in the same manner.

Before the bottom-most panel-insulation unit is installed, a bottom finish strip 92 is secured to the wall by nails 91. The bottom finish strip 92 may have horizontally extended slots for receiving the nails, if desired, similar to the slots 78 in starter 18. The finish strip 92 is provided at the bottom with integral, vertically spaced, outwardly extending flanges 93 and 94. Each flange is provided with a series of locking barbs 95 which are inclined toward the other flange at an angle toward the building wall. Mating with the finish strip 92 is a female member 96 having a flange 97 adapted to be extended into the space between the flanges 93 and 94. The flange 97 has locking barbs 98 on both the upper and lower surfaces which are inclined away from the building wall and cooperate with the locking barbs 95 to retain the flange 97 of female number 96 in locked engagement with the finish strip 92. FIG. 6 shows the female member 96 separated from the finish strip 92 in solid lines and assembled therewith in dot-dash lines. The female member provides a finished appearance at the bottom of the wall.

What is claimed is:

1. Panel siding for the wall of a building or the like, comprising a plurality of elongated panels arranged in a common plane in close, parallel relationship with the longitudinal edges of adjacent panels opposed to one another, said panels having integral tongue and groove formations along said opposed longitudinal edges interengaged to provide connections between said panels, and means for securing said panels to said wall, each panels having a front face between said longitudinal edges thereof, and an elongated layer of insulation on the rear side of each panel, each said layer of insulation having a main body portion and a lateral extension of said main body portion, each said panel having laterally spaced, integral insulation retainers on the rear side thereof engaging and retaining said main body portion of said layer of insulation on the rear side thereof, said lateral extension of said layer of insulation on the rear side of a panel extending along the rear side of said groove formation of said panel and terminating in substantial abutment with the main body portion of the layer of insulation ont he rear side of the adjacent panel, said insulation retainers of each panel extending throughout the length of said panel and being open at the panel ends enabling said layer of insulation to be assembled with said panel by an endwise sliding movement, said insulation retainers of each panel being inclined toward one another in a rearward direction, and said layer of insulation being a preformed, relatively stiff body of insulation material and said main body portion thereof having sides shaped to conform with and engage said insulation retainers.

2. The panel siding defined in claim 1, wherein each said groove formation comprises a channel formed in one of said opposed edges, and each said tongue formation frictionally engages in said channel.

3. The panel siding defined in claim 2, wherein each said tongue formation comprises a U-shaped projection having a terminal edge engaging a wall of said channel to provide a moisture seal.

4. The panel siding defined in claim 3, wherein each said panel and layer of insulation comprises a-preassembled panel-insulation unit.

5. The panel siding defined in claim 4, wherein said means for securing said panels to said wall comprises an integral attaching strip on each said panel, said attaching strip having fastener-receiving slots, said slots being elongated to permit movement of said strips due to expansion and contraction.

6. The panel siding defined in claim 5, including a starter strip at the bottom of said panel-insulation units, said starter strip having an upwardly opening channel providing a groove for receiving the tongue of the panel of the lowermost panel-insulation unit.

7. The panel siding defined in claim 5, including a starter strip at the top of said panel-insulation units, said starter strip having a downwardly opening channel providing a groove for receiving the tongue of the panel of the upper-most panel-insulation unit.

8. A panel system useful for side walls and the like comprising:

a plurality of elongated plastic panels, each said panel having being made of a relatively thin strip which is relatively stiff, each said panel having parallel longitudinal edges, each said panel having a front wall and a rearwardly turned first wall extending laterally away from one edge of said front wall, an integral second wall extending from said laterally extending first wall spaced from the front wall to define a groove, a third integral wall extending laterally from said second wall, and a fourth integral wall extending from said third wall and extending generally parallel to said second wall and cooperating with said second wall and third wall to define a groove, a generally U-shaped integral tongue extending from the other edge of said front wall, said tongue comprising spaced walls connected by an integral arcuate connecting portion, one of said walls of said tongue extending from said front wall, the other of said walls of said tongue extending from said connecting portion along the rear of the front wall of the tongue, said walls of said tongue being arcuate and spaced apart at the top and bottom and have intermediate arcuate portions, the distance on said tongue between the one wall and the free edge of the other wall of said tongue at the top and bottom of the tongue in the free, unflexed condition of the tongue being slightly greater than the width of said groove of the adjacent panel such that the tongue of one panel functionally engages the groove of an adjacent panel at the top and bottom and at the arcuate connecting portion.

9. The panel system set forth in claim 8 wherein said fourth wall of such said panel extends outwardly to define means for attaching said panel.

10. A panel system useful for side walls and the like comprising:

a plurality of elongated panels, each said panel having being made of a relatively thin strip which is relatively stiff, each said panel having parallel longitudinal edges, each said panel having a front wall and a rearwardly turned first wall extending laterally away from one edge of said front wall, an integral second wall extending from said laterally extending first wall spaced from the front wall to define a groove, a third integral wall extending laterally from said second wall, and a fourth integral wall extending from said third wall and extending generally parallel to said second wall and cooperating with said second wall and third wall to define a groove, a generally U-shaped integral tongue extending from the other edge of said front wall, said tongue comprising spaced walls connected by an integral connecting portion, one of said walls of said tongue extending from said front wall, the other of said walls of said tongue extending form said connecting portion and having a free edge, the distance on said tongue between the one wall and the free edge of the other wall of said tongue in the free, unflexed condition of the tongue being slightly greater than the width of said groove such that the tongue of one panel functionally engages the groove of an adjacent panel, said fourth wall of such said panel extending outwardly to define means for attaching said panel.

11. The panel system set forth in claim 10 including weep holes in said panel adjacent said other edge of said front wall.

12. The panel system set forth in claim 11 wherein said third wall of each said panel is inclined inwardly to define an insulation retainer for retaining a generally trapezoidal block of insulation, each said panel having integral portions folded on one another and are inclined inwardly form the other edge of the front wall to define an insulation retainer for said block of insulation.

13. The panel system set forth in claim 12 including a block of insulation between said insulation retainers and having edges with a configuration conforming to the configuration of the insulation retainers.

14. The panel system set forth in claim 13 wherein said block of insulation includes an integral extension extending along the fourth wall and terminating adjacent to the adjacent block of insulation in an adjacent panel.

15. The panel system set forth in claim 10 including a starter strip at the bottom of said panel-insulation units, said starter strip having an upwardly opening channel providing a groove for receiving the tongue of the panel of the lowermost panel-insulation unit.

16. The panel system set forth in claim 10 including a starter strip at the top of said panel-insulation units, said starter strip having a downwardly opening channel providing a groove for receiving the tongue of the panel of the upper-most panel-insulation unit.

17. The panel system set forth in claim 10 wherein said means for securing said panels to said wall comprises an integral attaching strip on each said panel, said attaching strip having fastener-receiving slots, said slots being elongated to permit movement of said strips due to expansion and contraction.

* * * * *